United States Patent [19]

Schörnig et al.

[11] 4,091,404

[45] May 23, 1978

[54] APPARATUS FOR DEVELOPING PHOTOSENSITIVE MATERIAL

[75] Inventors: Eberhard Schörnig, Taunusstein; Gerhard Naumann, Wiesbaden-Biebrich, both of Germany

[73] Assignee: Hoechst Aktiengesellschaft, Germany

[21] Appl. No.: 651,316

[22] Filed: Jan. 22, 1976

Related U.S. Application Data

[63] Continuation of Ser. No. 318,837, Dec. 27, 1972, abandoned.

[30] Foreign Application Priority Data

Dec. 28, 1971 Germany ..... 2164981

[51] Int. Cl.[2] ..... G03D 3/08; G03G 15/10

[52] U.S. Cl. ..... 354/321; 118/DIG. 23; 118/662; 354/325; 354/331; 355/10

[58] Field of Search ..... 355/10; 354/297, 301, 354/319, 320, 321, 325, 331, 339; 427/15; 118/DIG. 23, 659, 660, 662

[56] References Cited

U.S. PATENT DOCUMENTS

| | | | |
|---|---|---|---|
| 2,527,744 | 10/1950 | Lathem et al. | 118/DIG. 23 |
| 3,057,282 | 10/1962 | Luboshez | 354/301 |
| 3,088,391 | 5/1963 | Sigler | 134/58 |
| 3,155,546 | 11/1964 | Dirks | 118/DIG. 23 |
| 3,202,526 | 8/1965 | Ostensen | 427/15 |
| 3,249,088 | 5/1966 | Ostensen | 118/DIG. 23 |
| 3,368,525 | 2/1968 | Sacre | 118/662 |
| 3,379,113 | 4/1968 | Hosoya et al. | 354/339 X |
| 3,416,860 | 12/1968 | Mihojevich et al. | 355/10 |
| 3,435,751 | 4/1969 | Goodman et al. | 354/297 X |
| 3,442,254 | 5/1969 | Akiyama et al. | 118/637 |
| 3,643,628 | 2/1972 | Sugarman et al. | 118/659 |
| 3,687,049 | 8/1972 | Koch et al. | 354/318 X |

FOREIGN PATENT DOCUMENTS

| | | | |
|---|---|---|---|
| 938,349 | 10/1963 | United Kingdom | 355/10 |

*Primary Examiner*—Fred L. Braun
*Attorney, Agent, or Firm*—James E. Bryan

[57] ABSTRACT

An apparatus for developing photosensitive material which comprises passing the material into a bath of circulating developer fluid at a relatively static portion thereof and discharging the material from the bath below the surface of the fluid through a nip between two squeeze rollers. The fluid is prevented from escaping from the bath at the discharge end due to the cooperation between a sealing lip on the lower guide plate of the bath and the nip formed by the squeeze rollers.

5 Claims, 3 Drawing Figures

APPARATUS FOR DEVELOPING PHOTOSENSITIVE MATERIAL

This is a continuation of application Ser. No. 318,837, filed Dec. 27, 1972, now abandoned.

The present invention relates to a method of and apparatus for developing photosensitive material, especially electrophotographic copying material.

Methods of developing photosensitive materials by passing them through fluids are known. It has been proposed to pass the material between pairs of feed and discharge rollers and through a developing bath in which the developing fluid is circulating. A disadvantage in this system is that treatment by the fluid cannot be carried out right up to the gap between the discharge rollers, so that, between the point of discharge from the fluid bath and the point at which the residual fluid is squeezed off by the pair of discharge rollers, the fluid, as it drains off, can cause irregularities such as troublesome striations on the copying material.

It also has been proposed to carry out the developing process simply with a developing fluid in the gap between squeeze rollers without passing the material through a bath. This is done by spraying the squeeze rollers and thereby distributing the liquid over the material right within the gap. This method has the disadvantage of a relatively short treatment time which does not in every case ensure adequate developing. It also has been proposed to apply the developer by means of a triple roller arrangement consisting of immersion, applicator and pressing rollers. Here again, there is the danger that too little fluid and/or solid material is applied, and consequently the developing may be incomplete. It also has been proposed to pass material through the developing bath in such a way that the developing fluid wets the material all the way to the gap between the squeeze rollers, by capillary forces which form a meniscus between the material and the guide means. In this case, however, the coated side of the material easily can come into contact with the guide means positioned close to it, so that the picture may be spoiled by slight defects caused by the rubbing action. Furthermore, this meniscus is formed only above a certain speed of travel, and this may result in the developing time being too short.

Finally, it also has been proposed to develop rolled copying material by passing it between two rollers; in this method at least that roller that contacts on the rear side of the material and is coated with an elastomeric substance is moved through the developing fluid which is in a container of semi-cylindrical cross-section, squeezing being carried out by pressure applied by a polished grounded metal roller when the material leaves the fluid. A disadvantage here is that it is not possible to develop single sheets, that have to be bent through 180°, on account of the absence of guide means on the outer coated face of the material. Furthermore, replenishment of the developing bath to achieve a uniform composition can be carried out only with difficulty in an arrangement of this kind.

None of the known methods has hitherto given complete satisfaction, although in some instances considerable expense and relatively complicated application techniques have been used.

The present invention provides a method and an appropriate apparatus with which, irrespective of the form of the material, whether in rolls or in single sheets, copies may be produced, the apparatus being of simple construction and easy to operate.

The present invention provides a method of developing photosensitive material, especially electrophotographic copying material, by moving the material between feed and squeeze means through a circulating fluid wherein the material is introduced into a relatively static part of the fluid being substantially retained by the squeeze means and is discharged below the surface of the fluid while being squeezed. The material is then, optionally, dried.

In this way, the material to be developed which may be in any required form is surrounded in a simple manner by circulating fluid of uniform composition right up to the point where squeezing takes place. Furthermore, the speed of travel of the material through the developer can be readily adjusted to suit the type of material under treatment.

The method of the invention is of general application and can be used for developing operations in, for example, photography, in the diazo system and especially in the removal of coatings from printing plates. The method of the invention has proved particularly successful in the developing of electrophotographic copying materials.

In the method according to the invention, the material is initially moved into a relatively static part of the circulating fluid for the purpose of being developed, so that it is wetted in a uniform manner, and it is then passed through a squeezing means, e.g. a pair of rollers, which have the effect of retaining the liquid. The feed and squeezing means employed may be the known types of rollers normally used for the purpose. Thus, for example, polished metal rollers, rollers faced with elastomeric substance or combinations of rubber rollers can be used. According to the invention, rollers having high electrical resistance are used on the coated side of the material in the electrophotographic process; the rollers may for example be made of rubber, plastic material, glass or porcelain having a specific electrical resistance greater than approximately $10^{14}$ ohm . cm.

The speed of travel of the material through the developer will depend upon the type of material to be developed and upon the treatment time needed, and can be adjusted accordingly. Speeds in the range of approximately 0.2 to 10 m/min are preferred, but greater speeds also can be used.

Generally, the developing fluids used are those that have been found suitable for the aforementioned applications, i.e. aqueous solutions, dispersions and organic fluids are used, for example, for electrophotographic purposes. These developing fluids are composed of a liquid phase having high electrical resistance and a fine solid phase dispersed therein. The particles of the solid phase may settle out, in which case provision must be made for keeping the developing fluid thoroughly mixed.

The particles can be charged triboelectrically, and as a result of the electrostatic forces that occur are deposited on the areas of the coating from which the charge has not been removed. The deposited particles adhere loosely to the electrophotographic coating to form the pattern of the image, and can be fixed in the customary manner by heating or by the action of solvents or solvent vapors. A planographic, relief or intaglio printing plate or film can be obtained as required by hydrophilizing the parts of the coating not covered with particles, by removing the coating and, optionally, by etching, which steps can be carried out in the same in-line series of operations as the developing method of the invention.

After passing through the gap between the squeezing rollers, the degree of dryness of the material may differ, depending upon the fluid used and the pressure of the squeezing rollers. In some cases, it may be necessary to carry out a drying treatment using warm air, for example.

The method of the invention can be used with particular advantage when latent electrostatic images are to be developed on hard, e.g. metallic, carrier materials. In this case it has been found advantageous to carry out the squeezing on the coated side of the material by means of a roughened surface. It has also been found that a wedge-shaped body of fluid of increased pressure is formed in the gap between the squeezing means and the coated side of the material. When one of the numerous points forming the image is introduced into the gap, the pressure of the fluid builds up on the surface of the particles forming this point. This results in the fluid being pressed into the point between the loose particles of solid material lying on the coating and in their extending the point rearwardly. The particles thus form undesirable "tails". According to the invention this effect is avoided by the use of roughened surfaces on the squeezing means applied to the coated side of the material.

The degree of roughening is limited on the one hand by the narrowness of the gap between the squeezing rollers and on the other by the required degree of drying of the material as it is discharged. Thus, for example, excessive roughening leads to a reduced squeezing action, i.e. the plates remain too wet. Furthermore, an excessively coarse surface structure of the squeezing roller would be reproduced in the image.

Different relatively smooth rollers may be considered for use as the roughened squeezing means acting on the coated side of the material. Success has been achieved with rollers having high electrical resistance and provided with a polytetrafluoroethylene (e.g. Teflon®) covering, or rollers made of ceramic oxidic material. A roller having a roughened glass surface has given particularly good results.

The roughening is preferably in a range of from a few $\mu$ to about 20$\mu$. A preferred range is from approximately 5 to 15$\mu$. A typical degree of roughening is illustrated in greater detail by reference to the accompanying FIG. 1. The roughening is measured by probing the surface of the roller with a fine rounded diamond point in the axial direction (250 $\mu$-direction) and determining the height of the peaks (2.5 $\mu$-direction).

For the purpose of achieving roughening, radial grooves having the above-stated dimensions are ground in the rollers. It is also possible for the rollers to be constituted by commercially available glass tubes if they meet the specified requirements as in the case, for example, of KPG tubes having a medium ground finish (9$\mu$ max.) and as supplied by Messrs. Schott und Gen. of Mainz, Germany.

Because of the electrical charge pattern, it is preferred to use as the feed roller which contacts the coated side of the material one that is made of the same high-resistance material and that optionally has the same surface condition as the squeeze roller.

In the case of certain recording materials such as electrophotographic printing plates having a high coating capacity, the surface structure of the roughened feed roller can manifest itself in a somewhat troublesome manner in the very fine detail. In this case it is preferable to wet the two feed rollers or the feed roller on the coated side of the recording material with the developer fluid.

The invention further provides apparatus suitable for performing the method of the invention, which comprises means for supporting the photosensitive material and moving it through a bath of developing fluid, in which the bath containing the developing fluid comprises a pair of squeeze rollers, a slightly bowed inclined base and supporting element, the lower end of which is positioned close to the gap between the squeeze rollers, and a pair of side walls. The apparatus also may comprise a circulating system for the developing fluid. By means of this simple arrangement the developing fluid is in contact with the material right up to the gap between the rollers and, particularly in the case of electrophotographic developing, large quantities of particles of solid material dispersed in the developing fluid are applied to the recording material.

The apparatus of the invention will now be described in greater detail by reference to accompanying drawings, in which.

Figure 1:
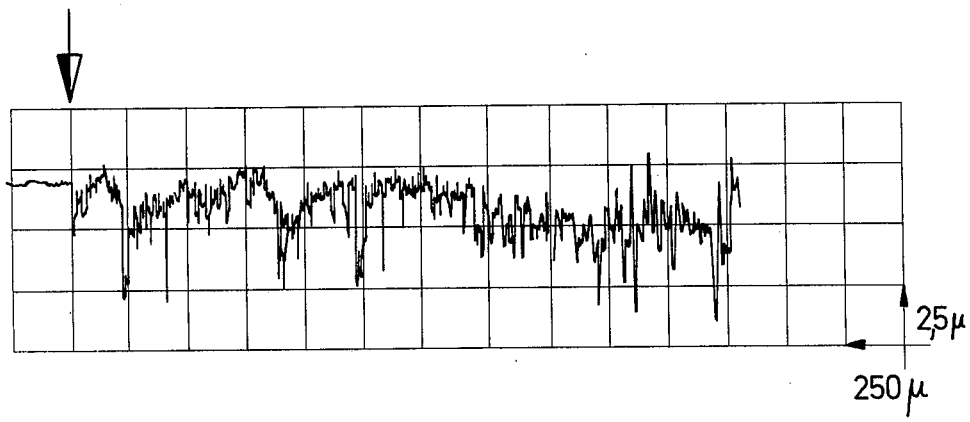
FIG. 1 shows a typical degree of roughening of the squeezing roller.
Figure 2:
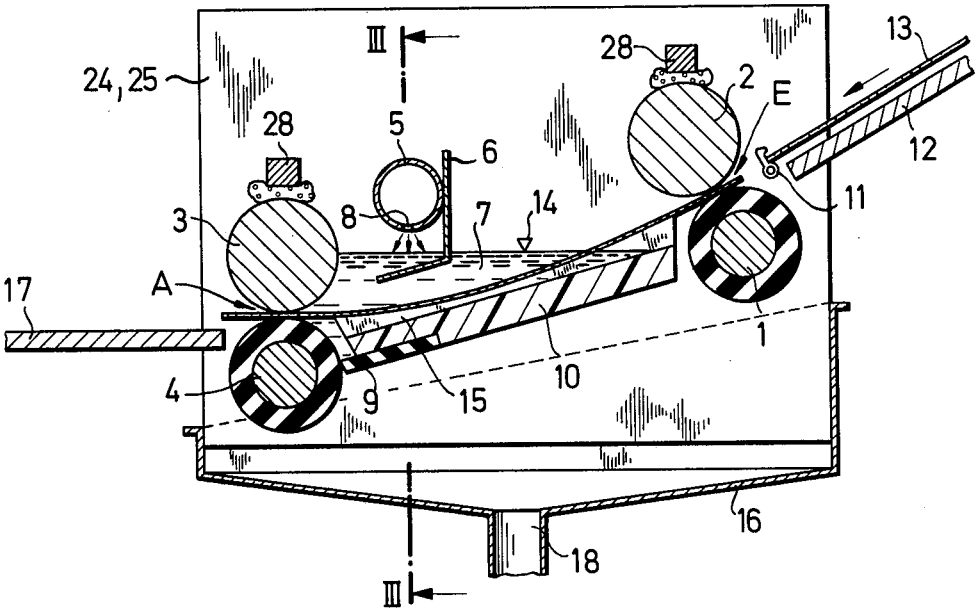
FIG. 2 is a diagrammatic sectional illustration of the developing portion in accordance with the invention.

A material 13, for example, an exposed electrophotographic printing plate, is placed on a feed table 12 with the latent charge pattern facing upwards. It has been found that it is advantageous if the feed table is inclined to a certain extent. This enables the material 13 to slide evenly towards a stop 11 which is disposed parallel with the rollers and enables the material to be introduced into the roller gap E in a precise manner. There are two stages to the operation of the apparatus. The first stage is initiated by actuating the main switch, this causing swirling to be induced in developing fluid 29 in a tank 22 with the aid of a stirring means 20 (FIG. 3), while at the same time a pump 26 is started up and the bath 7 is filled.

When the printing plate 13 is placed on the feed table 12, the second phase is initiated mechanically by means of a lever and in conjunction with electrical switches. Pairs of feed rollers 1, 2 and squeeze rollers 3, 4 to which no force is applied while they are in the non-operating position, are pressed together by mechanical means and the drive motor (not shown) for turning the rollers is switched on. It has been found advantageous to drive only the lower rollers 1 and 4 of each pair. At the same time the stop 11 is released and, if necessary, a baffle 6 is moved in front of the jets issuing from spraying orifices 8. By means of an electrical switching arrangement, the movement of the rollers is delayed in such manner that the bath 7 of developing fluid is built up to a suitable level 14 before movement of the recording material is begun. During operation the developing fluid 29 is drawn from the supply tank 22 by the pump 26 and forced through a supply pipe 19 and into a spraying pipe 5 whence it issues through the orifices 8. The rollers 1 and 4 each consist of a metallic core which is covered with resilient material, such as rubber. Various rubbers of different hardnesses are suitable, and multilayer rubber rollers may also be used. The rollers 2 and 3 are metal rollers which may be polished, or may be covered with elastomeric material. In the case of developing operations for electrophotographic purposes, rollers having high electrical resistance are used, for example rollers made of rubber, plastic material, glass or porcelain.

The rollers 2 and 3 may be fitted with wipers 28 which clean the surfaces. Wipers are particularly important in developing operations for electrophotographic purposes, since they spread any slight electrical charge picked up from the coating side of the recording material and render the charge ineffective. As is customary, the wipers 28 are made of foamed material, for example polyurethane, which is pressed against the rollers 2 and 3.

Retention of the developing fluid is achieved by means of the pair of squeeze rollers 3 and 4, a sealing lip 9, an inclined slightly bowed supporting sectional element 10 and side walls 24 and 25. The provision, on each side, of overflow openings 27 ensures that the fluid is always at a certain level 14 which is higher than the squeeze gap A. After it has been moved away, the stop 11 permits the printing plate to move off the inclined feed table, through the feed gap E and into the bath of developing fluid. This preferably takes place in a zone that is relatively free from motion, especially turbulent motion with splashing. This for example avoids spotting of the dry printing plate, which would lead to stains or streaking on the copies. The baffle 6 which is moved in front of the orifices 8 in the spraying tube prevents the photosensitive material from being heavily sprayed. This is particularly important when the material concerned is for electrophotographic purposes, since the particles of solid material adhere to the points forming the image only as a result of slightly differing electrical charges. An uninterrupted jet would erode the particles previously applied to the material. On the other hand, a strong jet is required in order to build up the bath as rapidly as possible and to prevent settling of the particles of solid material in the almost horizontal zone of the supporting sectional element 10.

Figure 3:
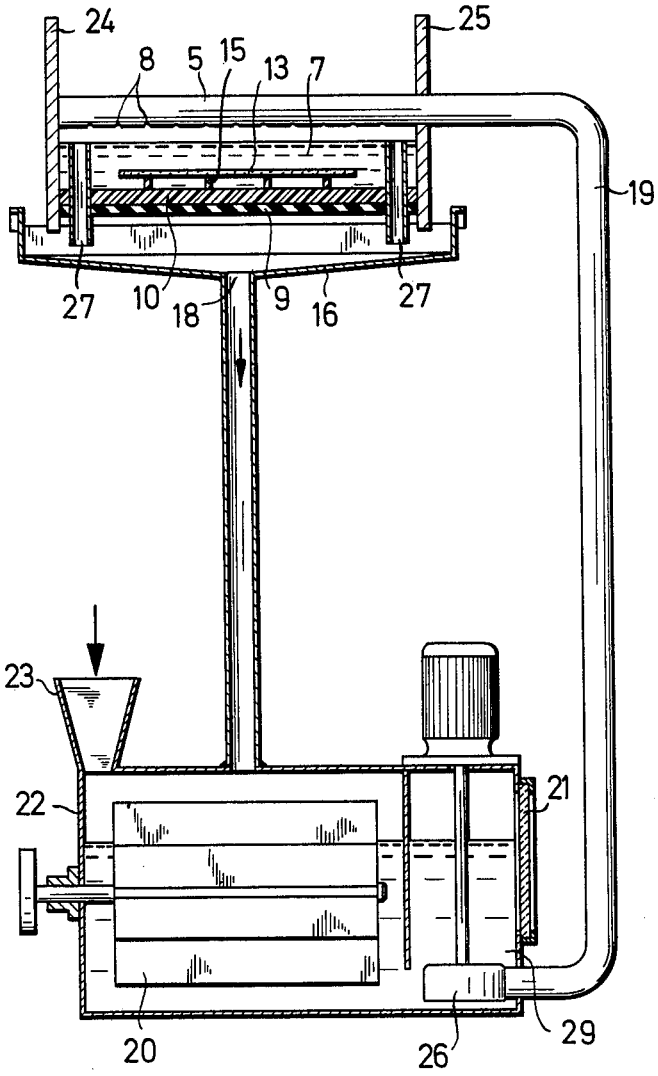
FIG. 3 shows the entire system including the means for circulating the developing fluid.

The material is moved over the element 10 which, as previously stated, is inclined and slightly bowed. The developed printing plate 13 is guided into the squeezing gap A by the supporting element 10 and by way of longitudinal ribs 15. The printing plate leaves the apparatus of the invention in a slightly wet state and passes on to a delivery table 17 where it completely dries off after a short time and can be passed on for further treatment. A collecting trough 16 fitted below the developing portion of the apparatus receives the fluid that overflows and leaks, and passes it back through a discharge duct 18 to the supply tank 22 (FIG. 3). The level of the developing fluid can be seen at any time through an inspection window 21, and the fluid can, if necessary, be topped up by adding further fluid by way of a funnel 23.

The developing of materials of large format necessitates the use of relatively long rollers. To ensure even pressure over the entire length of contact of the pair of squeeze rollers, the roller operating on the carrier side of the recording material is barrelled in the customary manner to compensate deflection.

By using the apparatus of the invention, it is possible to achieve even wetting of the squeeze rollers without the use of complicated means, this even wetting being a prerequisite to obtaining exact copies and this is particularly important in the case of printing plates since these must be completely free from irregularities if they are to be capable of use for industrial purposes.

It will be obvious to those skilled in the art that many modifications may be made within the scope of the present invention without departing from the spirit thereof, and the invention includes all such modifications.

We claim:

1. Apparatus for the liquid development of electrophotographic reproduction material, comprising a bath of developer liquid delimited by side walls, a bottom of a slightly curved support, a sealing lip, and a pair of squeeze rollers positioned near a lower end of said support, which support is adapted to guide said reproduction material in said developer liquid, a circulation system of circulating said developer liquid including a spraying pipe arranged above the open upper surface of said developer liquid, said spraying pipe being positioned near said squeeze rollers and partially screened by a baffle against said slightly curved support, and said developer liquid being dammed up by said pair of squeeze rollers to a height such that a sealing nip between said pair of squeeze rollers is completely submerged under said upper surface of the developer liquid.

2. Apparatus as claimed in claim 1 wherein said baffle is of angular shape and is so mounted that one side of the angle screens said spraying pipe from a pair of feed roller, whereas the other side of the angle screens said spraying pipe from said slightly curved support.

3. Apparatus as claimed in claim 1 wherein the surfaces of an upper feed roller and an upper squeeze roller have an average depth of roughening between 5 and 20$\mu$m.

4. Apparatus as claimed in claim 3 including a wiper in contact with said upper feed roller and said upper squeeze roller for cleaning the roller surfaces.

5. Apparatus as claimed in claim 1 wherein said support together with said side walls forms a tray for said liquid bath, and including overflow means near said side walls of said tray, upper edges of which overflow means are above said nip between said squeeze rollers.

* * * * *